US005376291A

United States Patent [19]

Watanabe

[11] Patent Number: 5,376,291

[45] Date of Patent: Dec. 27, 1994

[54] BONDED MAGNET MOLDING COMPOSITION AND BONDED MAGNET

[75] Inventor: Ryoji Watanabe, Ibaraki, Japan

[73] Assignee: ICI Japan Limited, Ibaraki, Japan

[21] Appl. No.: 10,724

[22] Filed: Jan. 29, 1993

[51] Int. Cl.[5] ..... H01F 1/22

[52] U.S. Cl. ..... 252/62.54; 252/62.58; 252/401

[58] Field of Search ..... 252/62.54, 62.58, 401

[56] References Cited

U.S. PATENT DOCUMENTS 3,887,477 6/1975 Brachman et al. ..... 252/401
5,079,307 1/1992 Taylor et al. ..... 525/420

FOREIGN PATENT DOCUMENTS 443663 12/1991 European Pat. Off. .
181403 1/1987 Japan .
185002 12/1989 Japan .

OTHER PUBLICATIONS

Patent Abstracts of Japan, vol. 15, No. 405 (E-1122) Oct. 1991 re JP-31 65504.
Patent Abstracts of Japan, vol. 11, No. 004 (E-458) Jan. 1987 re JP-61 179 506.
Patent Abstracts of Japan, vol. 16, No. 358 (C-0970) Aug. 1992 re JP-41 10 347.

*Primary Examiner*—John Niebling
*Assistant Examiner*—Edna Wong
*Attorney, Agent, or Firm*—Cushman, Darby & Cushman

[57] ABSTRACT

Compositions for making a bonded magnet product by conventional moulding techniques comprise high amounts of magnetic particles together with a polyamide resin and from about 0.2 to 3% by weight of a hindered phenol compound.

11 Claims, No Drawings

BONDED MAGNET MOLDING COMPOSITION AND BONDED MAGNET

BACKGROUND OF THE INVENTION

Our invention relates to compositions suitable for providing magnets, and more especially magnets which are formed by moulding of the composition. The resulting bonded magnet products exhibit excellent magnetic properties. The moulding compositions exhibit good mouldability and are heat stable during the moulding process.

THE PRIOR ART

Bonded magnets formed from compositions comprising organic thermoplastic resins together with magnetic materials are well know. Such products having a complex shape can be moulded by for example, an injection moulder, an extrusion moulder or a compression moulder without post-treatment. Such compositions are conventionally used for bonded magnet moulding in various applications. Moreover, because of the desire to make lighter and smaller electric products, autoparts, etc. for electronics product, printer and others, it is a big advantage to make a bonded magnet with high performance. However, to make such a product it is necessary to increase the addition of the magnetic material, while maintaining the mouldability of the composition.

For example, in the Official Gazette of Japanese Patent Laid-Open 1987-123702, a composition is described which comprises magnetic powder treated on the surface with a coupling agent and synthetic resin. In the Official Gazette of Japanese Patent Laid-Open 1988-181403, the use of copolymer is disclosed. In the Official Gazette of Japanese Patent Laid-Open 1990-65103, use of additives, to try to improve the magnetic property and to improve the mouldability such as flowability, etc. is described. However, there has not been any composition described which provides the addition of very high amounts of the magnetic material, i.e. 65% or more with volume ratio (approximately corresponding to around 93% or more when expressed by weight, depending on substance, which constitutes the composition.), and maintaining both heat stability and flowability, and also exhibiting a strong mechanical strength in the resulting moulded article, while maintaining the magnetic property.

Accordingly, it is the primary object of the present invention to provide a bonded magnet moulding composition having a high load of magnetic particles, good mouldability and heat stability, for use in conventional moulding processes.

This invention further provides a bonded magnet moulding composition which can be moulded particularly to a thin thickness having high magnetic property by injection and/or extrusion moulding without problems such as deterioration of the flowability, deterioration of the heat stability, deterioration of the mechanical strength after the moulding, etc. The magnetic property of the bonded product is improved by making a high density filling of the magnetic material.

These and other objects of the present invention will be more apparent from the discussion which follows.

DETAILED DESCRIPTION OF THE INVENTION

We have found through our research a bonded magnet moulding composition which, during the moulding process, exhibits good flowability and is heat stable. The resulting moulded magnet product exhibits improved mechanical strength.

The bonded magnet moulding composition comprises a polyamide resin in combination with magnetic particles and from about 0.2 to about 3% by weight of a hindered phenol compound as defined below.

We have found that such a composition allows for the use of high amounts of magnetic material particles (e.g. the incorporation of a high density of magnetic particles—to a density of 65% or more on a volume basis). This equates to at least about 93% by weight of the total moulding composition.

As used herein, the term hindered phenol compound refers to hydrazine compound having a hindered phenol structure which may be represented by the general formula.

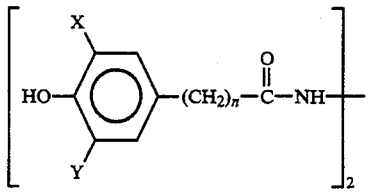

wherein:

n is an integer of from 2 to 4; X and Y, which may be the same or different are alkyl of from 1 to 4 carbon atoms (e.g. methyl, ethyl, propyl, isopropyl or butyl).

Preferably both X and Y, are the same, and most preferably, both are methyl.

As for the amount of the divalent phenol hydrazine compound having hindered phenol structure to be used in this invention, it is from about 0.2 to 3%, preferably 0.3–2.0 and most preferably about 0.7 to about 1.5% by weight % of the composition. If the incorporation amount is less than this range, acceptable heat stability and mouldability is not attained. On the other hand, if the amount is more, preferable magnetic property is not attained.

Examples of the divalent phenol hydrazine compound having a hindered phenol structure include IRGANOX MD1024 (Ciba-Geigy product) which is a tert-butyl substitute of the hindered phenol hydrazine (not shown), N,N'-bis[3-(3,5-dimethyl-4-hydroxyphenyl)propinonyl]hydrazine shown by the following chemical formula 1, or N, N'-bis[3-(3,5-di-t-butyl-4-hydroxyphenyl)alkanoyl]hydrazines shown by the following chemical formula 2 and chemical formula 3:

Chemical formula 1

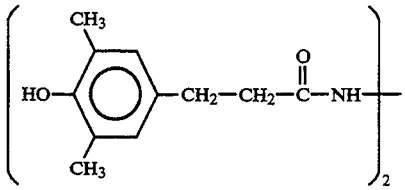

Chemical formula 2

-continued

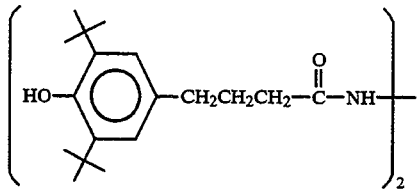

Chemical formula 3

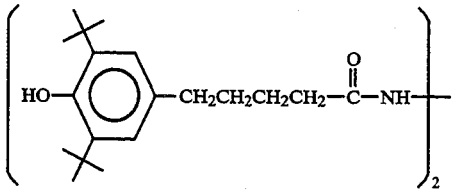

The magnetic material which can be used in this invention refers to magnetic or magnetization capable material. Therefore, the magnetic material does not need to be magnetized itself as far if it can be magnetized by application of magnetic field during producing of the magnet or after the production.

The polyamide resin which is used contains from about 1 to 70% by weight of the resin, and preferably about 20 to about 50% by weight of a polyamide copolymer. Suitable polyamide type resins include 6-nylon, 6,6-nylon, 12-nylon, etc., but the invention is not limited to them.

The polyamide copolymer which is used in this invention is a copolymer of different polyamide type resins such as 6-nylon and 12-nylon, 6-nylon and 6,6-nylon, etc.

The magnetic particles can be those conventionally known in the art and the particle size may vary to suit the need, as it is not critical. As noted, high levels of the magnetic particles are to be included, i.e. about 93% by weight of the composition or higher.

The magnetic material can be, for example, ferrite materials such as barium ferrite ($BaO.6Fe_2O_2$) and strontium ferrite ($SrO\text{-}6Fe_2O_3$) as described in the Official Gazette of Japanese Patent Laid-Open 1989-162301 (incorporated by reference herein), intermetallic compounds of rare earth metals for the bonded magnet having high magnetic property (Sm, Ce, La, Y, Nd, Pr, Gd) with transition metals (Fe, Co, Ni, Zr, Hf, Cu, Ti), or intermetallic compounds comprising at least one of the rare earth metals and at least one of the transition metals basing on neodymium-iron-boron, etc. can be enumerated. Among these, particularly the magnetic material comprising neodymium-iron-boron can be suitably used for this invention.

If desired, a lubricant, a lubrication oil, etc. which are mould-processing auxiliaries, can be added. As for the lubricant, stearic acid, stearate, fatty acid amide, wax, etc. can be enumerated, and as for the lubricating oil, silicone oil, etc. can be enumerated. It is preferable that these auxiliaries are 0.05–0.5 weight % to the mixture of the magnetic material and the matrix resin.

As for raw material for the bonded magnet moulding of this invention, for example, 6,6-nylon pellets on the market can also be used as the substrate of the matrix resin, but it is preferable if it is powder form before pelletizing from viewpoint of evenness of mixing and kneading.

Examples of the invention follow, but the invention is not limited by them.

EXAMPLE 1

93.4% of neodymium-iron-boron powder (GM product, MQ-P powder), 5.5 weight % of 12-nylon powder (Ube Kosan product, P-3014U) and 1.0 weight % of a hydrazine compound (Ciba-Geigy product, IRGANOX MD1024) were placed in a henscheil mixer (Mitsuimiike Kako Product, FM10B) and were mixed for 1 minute. Then 0.1 weight % of silicone oil (Bayer product, PN-200) was added to the mixture and they were again mixed for 1 minute. The mixture was taken out, was placed in a hopper of a same direction biaxial extruder (Toshiba product, TEM-35M), kneaded at a temperature of 230°–250° C., and a bonded magnet moulding composition in pellet form was prepared. The composition of this example is summarized in Table 1.

The heat stability evaluation of the bonded magnet moulding composition obtained was done by kneading at 250° C. by using a labo-plastomill mixer (Toyoseiki Seisakusho product, 30C-150), it was measured by a torque elevation ratio, a value that a torque value after 10 minutes was divided by a torque value after 1 minute. Additionally, the viscosity of the pellets was measured at a shear rate of 1216 $sec^{-1}$ at 250° C. by using a capillary flow meter (Toyoseiki Seisakusho product, CAPIROGREAPH PM-C), and a bar flow was also evaluated by measuring a flow length with an injection pressure of 1400 $kg/cm^2$ at 270° C. with a bar flow die having a bar channel shape of 10 mm wide and 1 mm deep by using an injection moulder (Toshiba product, EPN-80 ).

In addition, injection mouldability of the composition was evaluated by , Δ and X with a cylindrical bonded magnet of 24 mm inside diameter, 26 mm outside diameter and 4 mm length by using an injection moulder (Toshiba product, EPN-80). indicates that it could be moulded by general moulding condition, A indicates that it could be moulded by a high temperature and a high injection pressure, and X indicates that a satisfactory moulding could not be achieved even by a high temperature and a high injection pressure.

The magnetic property (BH) max of the cylindrical bonded magnet obtained was measured by a BH tracer.

The results are shown in Table 1 below. The results illustrate a high quality composition with practical value on the heat stability, the injection mouldability and the magnetic property.

EXAMPLE 2

A bonded magnet moulding composition was prepared in a similar manner to Example 1 using the composition shown in the Table 1 as Example 2.

As for the bonded magnet moulding composition obtained, it was evaluated in the similar manner to the composition of Example 1.

The results are also shown in Table 1. It was a high quality composition with practical value on the heat stability, the injection mouldability and the magnetic property.

COMPARATIVE EXAMPLE 1

A bonded magnet moulding composition was prepared in the similar manner to the Example 1 by using composition shown in the Table 1 as the comparative Example 1.

As for the bonded magnet moulding composition obtained, it was evaluated in the similar manner to the Example 1 composition.

The results are also shown in Table 1, but the heat stability of the composition was inferior to the examples, though 10 times amount of silicone oil to the examples was used both values of the viscosity and the bar flow were unfavorable, and it could not be made the injection moulding. Accordingly, we were unable to measure the magnetic property.

COMPARATIVE EXAMPLE 2

A bonded magnet moulding composition was prepared in a manner like Example 1 by using the composition shown in the Table 1 as comparative Example 2.

As for the bonded magnet moulding composition obtained, it was evaluated in a similar manner to the Example 1 composition.

The results are shown in Table 1, but though a plasticizer was added, all of the heat stability, the viscosity and the bar flow were inferior to the examples according to the present invention, and the injection moulding was extremely difficult.

EXAMPLE 3

A bonded magnet moulding composition was prepared in the similar manner to Example 1 by using the composition shown in the Table 2 as the Example 3.

The bonded magnet moulding composition obtained was similar to Example 1. As regards the heat stability evaluation, it was measured by a torque elevation ratio, a value that a torque value after 10 minutes was divided by a torque value after 1 minute by using a labo-plastomill mixer (Toyoseiki Seisakusho product, 30C-150) by kneading at 250° C. Additionally, the viscosity of the pellets was measured with a shear rate of 1216 $sec^{-1}$ at 250° C. by using a capillary flow meter (Toyoseiki Seisakusho product, CAPIROGRAPH PM-C).

The extrusion mouldability of the composition was evaluated with a cylindrical bonded magnet of 20 mm outside diameter and 18 mm inside diameter by using a monoaxial extruder (Ikegai product, FS-40). indicates that it could be moulded to a cylindrical shape by general moulding condition, and X indicates that the moulding could not be achieved by stoppage in the die.

The results are shown in the Table 2. The composition was a high quality one with practical heat stability, extrusion mouldability and magnetic property.

COMPARATIVE EXAMPLE 3

A bonded magnet moulding composition was prepared in a similar manner to the Example 1 by using the composition shown in Table 2 as the Comparative Example 3.

As for the bonded magnet moulding composition obtained, it was evaluated in a similar manner to the Example 3.

The results are shown in Table 2. However, the heat stability was inferior to the example, though 5 times amount of silicone oil to the example was used, the viscosity shown was unfavorable value, and it could not be made the extrusion moulding. Accordingly, we were unable to measure the magnetic property.

EXAMPLE 4

A bonded magnet moulding composition was prepared in a manner similar to Example 1 by using the composition containing a polyamide copolymer shown in Table 3 as Example 4.

The bonded magnet moulding composition so obtained was similar to the Example 1. As for the heat stability evaluation, it was measured by a torque elevation ratio, a value that a torque value after 10 minutes was divided by a torque value after 1 minute by kneading at 250° C. by using a labo-plastomill mixer (Toyoseiki Seisakusho product, 30C-150). Additionally, the viscosity of the pellets was measured with shear rate of 24.3 $sec^{-1}$ at 210° C. by using a capillary flow meter (Toyoseiki Seisakusho product, CAPIROGRAPH PM-C).

An extrusion mouldability of the composition was evaluated with an arcuate bonded magnet of 4.6 mm outside diameter, 3.6 mm inside diameter and 7.1 mm width by using a monoaxial extruder (Ikegai product, FS-40). ⊙ indicates that one of the prefixed shape was moulded at high speed, indicates that one of the prefixed shape was moulded a low speed, Δ indicates that though the composition was extruded through the die, the shape was not the prefixed one due to unevenness of the edge section and X indicates that the moulding could not be achieved by stoppage in the die.

The results are shown in Table 3, but the composition was of high quality with good heat stability, extrusion mouldability and magnetic property.

EXAMPLES 5–7

Bonded magnet moulding compositions were prepared in a manner similar to Example 1 by using the compositions containing the polyamide copolymer shown in the Table 3 as the Examples 5–7.

As for the bonded magnet moulding compositions obtained, they were evaluated in a manner similar to Example 4.

The results are shown in Table 3. They were of high quality with good heat stability, injection mouldability and magnetic property.

COMPARATIVE EXAMPLE 4–5

Bonded magnet moulding compositions were prepared in a manner similar to Example 1 by using compositions shown in Table 3 as the comparative Examples 4–5.

As for the bonded magnet moulding compositions obtained, they were evaluated in a manner similar to Example 4.

The results are shown in Table 3. We could not carry out the extrusion moulding, and as for the other, it could only be moulded to one having uneven edges, and therefore these compositions had no practical value.

TABLE 1

| | Example | | Comparative Example | |
|---|---|---|---|---|
| | 1 | 2 | 1 | 2 |
| Composition (weight %) | | | | |
| Neodymium-iron-boron powder | 93.4 | 93.4 | 93.4 | 93.4 |
| 12-nylon | 5.5 | 5.2 | 5.2 | 5.9 |
| hydrazine compound[4)] | 1.0 | 1.2 | 0.4 | 0.2 |
| silicone oil | 0.1 | 0.1 | 1.0 | —.— |
| isostearic acid | —.— | —.— | —.— | 0.5 |
| Property | | | | |
| torque eleyation ratio[1)] | 0.9 | 0.8 | 1.5 | 1.8 |
| viscosity[2)] (k poise) | 8 | 6 | 12 | 10 |
| bar flow (cm) | 8 | 9 | 5 | 6 |
| injection mouldability[3)] | ∘ | ∘ | x | Δ |

TABLE 1-continued

| | Example | | Comparative Example | |
|---|---|---|---|---|
| | 1 | 2 | 1 | 2 |
| (BH) max (MGOe) | 6.8 | 6.8 | —.— | 6.6 |

[1]A value that a torque value after 10 minutes is divided by a torque value after 1 minute by kneading at 250° C. by using a labo-plastomill mixer (Toyoseiki Seisakusho product, 30C-150).
[2]A value obtained by measurement of the viscosity with shear rate of 1216 $sec^{-1}$ at 250° C. by using a capillary flow meter (Toyoseiki Seisakusho product, CAPIROGRAPH PM-C).
[3]○ means that it could be moulded by general moulding condition, Δ indicates that it could be moulded by a high temperature and a high injection pressure, and X indicates that a satisfactory moulding could not be achieved even by a high temperature and a high injection pressure.
[4]IRGANOX MD1024 (Ciba-Geigy product)

TABLE 2

| | Example 3 | Comparative Example 3 |
|---|---|---|
| Composition (weight %) | | |
| Neodymium-iron-boron powder | 93.9 | 93.9 |
| 12-nylon | 5.0 | 5.6 |
| hydrazine compound[4] | 1.0 | —.— |
| silicone oil | 0.1 | 0.5 |
| Property | | |
| torque eleyation ratio[1] | 0.8 | 2.2 |
| viscosity[2] (k poise) | 9 | 15 |
| extrusion mouldability[3] | ○ | x |
| (BH) max (MGOe) | 7.1 | —.— |

[1]A value that a torque value after 10 minutes is divided by a torque value after 1 minute by kneading at 250° C. by using a labo-plastomill mixer (Toyoseiki Seisakusho product, 30C-150).
[2]A value obtained by measurement of the viscosity with shear rate of 1216 $sec^{-1}$ at 250° C. by using a capillary flow meter (Toyoseiki Seisakusho product, CAPIROGRAPH PM-C).
[3]○ means that it could be moulded by general moulding condition, and X means that the moulding could not be achieved by stoppage in the die.
[4]IRGANOX MD1024 (Ciba-Geigy product)

TABLE 3

| | Example | | | | Comparative Example | |
|---|---|---|---|---|---|---|
| | 4 | 5 | 6 | 7 | 4 | 5 |
| Composition (weight %) | | | | | | |
| Neodymium-iron-boron powder | 93.9 | 93.6 | 94.9 | 94.8 | 93.9 | 93.9 |
| 12-nylon | 3.8 | 2.4 | 2.8 | 1.8 | 5.4 | 5.1 |
| 6,12-nylon copolymer | 1.3 | 2.5 | 1.0 | 1.9 | —.— | —.— |
| hydrazine compound[4] | 1.0 | 1.2 | 1.2 | 1.2 | 0.2 | 0.5 |
| silicone oil | 0.1 | 0.3 | 0.1 | 0.3 | 0.5 | 0.5 |
| Property | | | | | | |
| torque eleyation ratio[1] | 0.6 | 0.5 | 0.6 | 0.6 | 1.5 | 1.2 |
| viscosity[2] (k poise) | 85 | 90 | 460 | 95 | 110 | 102 |
| extrusion mouldability[3] | ○ | ◎ | ○ | ◎ | x | Δ |
| extrusion speed (mm/sec) | 2 | 4 | 1.5 | 4 | —.— | —.— |
| (BH) Max (MGOe) | 7.1 | 7.0 | 8.0 | 7.9 | —.— | —.— |

[1]A value that a torque value after 10 minutes is divided by a torque value after 1 minute by kneading at 250° C. by using a labo-plastomill mixer (Toyoseiki Seisakusho product, 30C-150).
[2]A value obtained by measurement of the viscosity with shear rate of 24.3 sec at 210° C. by using a capillary flow meter (Toyoseiki Seisakusho product, CAPIROGRAPH PM-C).
[3]◎ means that one of the prefixed shape was moulded at high speed, ○ means that one of the prefixed shape was moulded at a low speed, Δ means that though the composition was extruded through the die, the shape was not the prefixed one due to unevenness of the edge section and x means that the moulding could not be achieved by stoppage in the die.
[4]IRGANOX MD1024 (Ciba-Geigy product)

From the foregoing, it can be seen that the present invention offers a bonded magnet moulding composition with good mouldability, having improved magnetic properties by filling a high density of the magnetic material and ability to be moulded by an injection moulding and an extrusion moulding. Additionally, the magnet obtained does not exhibit deterioration of mechanical strength after the moulding. By either injection moulding or extrusion moulding, a magnet having the high performance magnetic property similar to those obtained by a compression moulding is obtained.

Since the polyamide copolymer has lower crystallinity and longer crystallization time than polyamide homopolymer, the bonded magnet moulding composition takes a long time for solidification in a die when it is processed by injection moulding, and thus the flowability during the processing is improved, and when it is processed by extrusion moulding, a solidification time at the exit of a die is long, and the pressure elevation at the edge of the die can be reduced and a load to screw can also be lightened. Also one can mould even if a bonded magnet moulding composition which is filled with high density of the magnetic material is used. Thus, according to the bonded magnet moulding composition of this invention, a bonded magnet with excellent magnetic property can be obtained.

We claim:

1. A bonded magnet molding composition comprising:

a) a polyamide resin;

b) from about 0.2 to about 3% by weight of a hindered phenol compound, wherein said hindered phenol compound has the chemical formula:

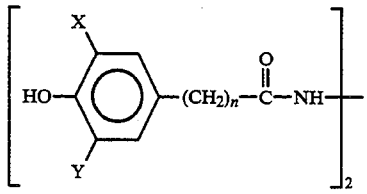

wherein:

n is an integer of from 2 to 4, X and Y, which may be the same or different, are alkyl of from 1 to 4 carbon atoms; and c) at least about 93% by weight of said composition of magnetic particles.

2. The magnet composition of claim 1, wherein both X and Y are the same.

3. The magnet composition of claim 1, wherein X and Y are both t-butyl.

4. The magnet composition of claim 1 wherein said polyamide resin comprises from 1 to 70% by weight of a polyamide copolymer.

5. The magnet composition of claim 1 wherein said magnetic particles comprise neodyomium-iron-boron powder.

6. A bonded magnet molding composition comprising:

a) a polyamide resin containing from 1 to 70% by weight of said resin of a polyamide-copolymer;

b) from about 0.2 to about 3% by weight of said composition of a hindered phenol compound, wherein said hindered phenol compound has the chemical formula:

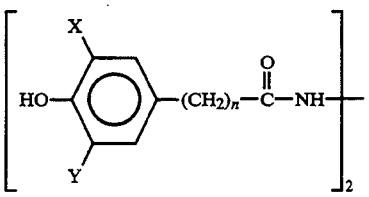

wherein:

n is an integer of from 2 to 4, X and Y, which may be the same or different, are alkyl of from 1 to 4 carbon atoms; and c) at least about 93% by weight of said composition of magnetic particles.

7. A bonded magnet formed by molding the composition of claim 1.

8. A bonded magnet molding composition comprising:

a) a polyamide resin;

b) from about 0.7 to about 3% by weight of a hindered phenol compound, wherein said hindered phenol compound has the chemical formula:

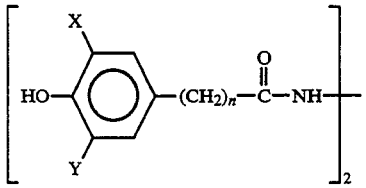

wherein:

n is an integer of from 2 to 4, X and Y, which may be the same or different, are alkyl of from 1 to 4 carbon atoms; and c) at least about 93% by weight of said composition of magnetic particles.

9. The magnet composition of claim 8 wherein said polyamide resin comprises from 1 to 70% by weight of a polyamide copolymer.

10. The magnet composition of claim 8 wherein said magnetic particles comprise neodymium-iron-boron powder.

11. A bonded magnet formed by molding the composition of claim 8.

* * * * *